US009597767B2

(12) United States Patent
Ishigami et al.

(10) Patent No.: US 9,597,767 B2
(45) Date of Patent: Mar. 21, 2017

(54) POLISHING MEDIA, METHOD FOR PRODUCING POLISHING MEDIA, AND POLISHING METHOD

(75) Inventors: Hideki Ishigami, Hachinohe (JP); Hidefumi Nakamura, Hachinohe (JP); Junichi Hayashi, Hachinohe (JP)

(73) Assignee: Seiko Epson Corporation (JP)

( * ) Notice: Subject to any disclaimer, the term of this patent is extended or adjusted under 35 U.S.C. 154(b) by 730 days.

(21) Appl. No.: 13/433,883

(22) Filed: Mar. 29, 2012

(65) Prior Publication Data

US 2012/0252322 A1 Oct. 4, 2012

(30) Foreign Application Priority Data

Mar. 30, 2011 (JP) ..... 2011-074394

(51) Int. Cl.

| | |
|---|---|
| ***B24B 1/00*** | (2006.01) |
| ***C09K 3/14*** | (2006.01) |
| ***B24B 31/02*** | (2006.01) |
| ***B22F 3/22*** | (2006.01) |
| ***C22C 1/10*** | (2006.01) |
| ***C22C 27/04*** | (2006.01) |

(52) U.S. Cl.

CPC ..... *B24B 31/02* (2013.01); *B22F 3/225* (2013.01); *C22C 1/1084* (2013.01); *C22C 27/04* (2013.01); *B22F 2998/10* (2013.01)

(58) Field of Classification Search

CPC ..... B24B 31/14; B24B 31/00; B24B 31/02; B22F 3/225; B22F 3/20; B22F 3/10; B22F 3/24; C22C 1/1084; C22C 27/04; C22C 1/1094

USPC ..... 451/32, 35, 328, 330

See application file for complete search history.

(56) References Cited

U.S. PATENT DOCUMENTS

| | | | | |
|---|---|---|---|---|
| 2,947,124 | A * | 8/1960 | Madigan et al. | 451/35 |
| 2,978,850 | A * | 4/1961 | Gleszer | 451/35 |
| 3,520,656 | A * | 7/1970 | Yates et al. | 423/345 |
| 4,945,073 | A * | 7/1990 | Dubensky et al. | 501/93 |
| 2004/0248723 | A1* | 12/2004 | Pujari et al. | 501/90 |
| 2009/0029315 | A1 | 1/2009 | Hayashi et al. | |
| 2009/0029317 | A1 | 1/2009 | Hayashi et al. | |
| 2009/0029318 | A1 | 1/2009 | Hayashi et al. | |
| 2009/0029321 | A1 | 1/2009 | Hayashi et al. | |

FOREIGN PATENT DOCUMENTS

| | | |
|---|---|---|
| JP | 63-267157 | 11/1988 |
| JP | 01-092060 A | 4/1989 |
| JP | 05-293753 | 11/1993 |
| JP | 2003-193036 A | 7/2003 |
| JP | 2009-028358 | 2/2009 |
| JP | 2009-028359 | 2/2009 |

(Continued)

*Primary Examiner* — Joseph J Hail
*Assistant Examiner* — Joel Crandall
(74) *Attorney, Agent, or Firm* — Harness, Dickey & Pierce, P.L.C.

(57) ABSTRACT

A polishing media is formed of a sintered body in which a metal structure and a ceramic structure are intermingled with each other. The polishing media is preferably produced by molding a mixed powder of a metal powder and a ceramic powder by an injection molding method and sintering the resulting molded article. Further, the ceramic structure is preferably formed of aluminum oxide, and the metal structure is preferably formed of tungsten.

6 Claims, 3 Drawing Sheets

(56) References Cited

FOREIGN PATENT DOCUMENTS

| | | |
|---|---|---|
| JP | 2009-028360 | 2/2009 |
| JP | 2009-028361 | 2/2009 |
| JP | 2009-195716 | 9/2009 |
| JP | 2009-291400 | 12/2009 |
| JP | 2010-059456 | 3/2010 |

* cited by examiner

POLISHING MEDIA, METHOD FOR PRODUCING POLISHING MEDIA, AND POLISHING METHOD

BACKGROUND

1. Technical Field

The present invention relates to a polishing media, a method for producing a polishing media, and a polishing method.

2. Related Art

As one of the methods for polishing a surface of a work (a material to be polished), barrel polishing is used. Barrel polishing is performed for the purpose of, for example, deburring, chamfering, surface finishing, or the like of a surface of a work made of a ceramic or a metal.

Barrel polishing is performed by putting a work and a polishing media in a barrel polishing tank and stirring these. When stirring the work and the polishing media, the work and the polishing media collide or rub against each other, whereby a surface of the work is polished.

As a material of the polishing media to be used for barrel polishing, a ceramic material is used because the material is required to have a high hardness. JP-A-5-293753 discloses a barrel stone made of aluminum oxide, zirconium oxide, silicon carbide, or the like.

In the meantime, when the work is small or has a complicated shape including a concave portion, a portion where contact between the work and the polishing media is not sufficient is generated, and polishing is not sufficient in the portion. Therefore, when barrel polishing is performed for such a work, it is necessary to use a small polishing media corresponding to the size or the shape of the work.

However, the small polishing media has a mass decreased to an extent corresponding to the decrease in the size and also the collision energy for the work is decreased, and therefore, a polishing force (polishing efficiency) is lacking at all. Due to this, it takes a lot of time to polish the work. Moreover, a ceramic material has a specific gravity less than a metal material or the like, and therefore the mass of the polishing media is further decreased.

On the other hand, JP-A-63-267157 discloses a media for barrel polishing obtained by providing an abrasive material layer containing superhard coating particles such as diamond or CBN on a surface of a metal ball core. If a polishing media has such a configuration, the mass of the media can be increased without decreasing the hardness of the surface, and therefore, even if the size of the polishing media is decreased, the polishing force hardly decreases.

In the barrel polishing, polishing proceeds in such a manner that a work and a polishing media rub against each other and abrade each other. However, in the case of the media disclosed in JP-A-63-267157, when the abrasion of the polishing media proceeds and at the time when the abrasive material layer is worn away, the polishing force is lost. Accordingly, there is a problem that the life of the polishing media is short.

SUMMARY

An advantage of some aspects of the invention is to provide a polishing media which has a high polishing force even if it is small and hardly causes a decrease in polishing force even if it is used for a long period of time, a method for producing a polishing media with which such a polishing media can be efficiently produced, and a polishing method with which polishing can be efficiently and uniformly performed.

An aspect of the invention is directed to a polishing media including a sintered body in which a metal structure and a ceramic structure are intermingled with each other.

According to this configuration, a polishing media which has a high polishing force even if it is small and hardly causes a decrease in polishing force even if it is used for a long period of time is obtained.

In the polishing media according to the aspect of the invention, in a cross section of the polishing media, an area occupied by the ceramic structure is preferably 0.1 or more and less than 1 when an area occupied by the metal structure is taken as 1.

According to this configuration, cracking, chipping, or the like is hardly caused in the polishing media. As a result, a high polishing force and durability can be achieved for the polishing media.

The polishing media according to the aspect of the invention preferably has a columnar shape or a conical shape.

According to this configuration, a useful polishing media having an excellent polishing property is obtained.

In the polishing media according to the aspect of the invention, the ceramic structure is preferably formed of aluminum oxide.

Aluminum oxide has a high hardness and also has relatively high impact resistance, and therefore can enhance the polishing force of the polishing media.

In the polishing media according to the aspect of the invention, the metal structure is preferably formed of tungsten.

Tungsten has a relatively high specific gravity and also has an excellent sintering property, and therefore can increase the specific gravity of the polishing media and enhance the impact resistance thereof.

In the polishing media according to the aspect of the invention, it is preferred that the ceramic structure is formed of a metal oxide, and a standard free energy of formation for an oxidation reaction of a metal element contained in the metal structure is larger than that of a metal element contained in the metal oxide.

According to this configuration, both of the metal material in the metal structure and the ceramic material in the ceramic structure can be stably present in the sintered body, and the durability of the polishing media can be prevented from decreasing.

In the polishing media according to the aspect of the invention, the sintered body is preferably obtained by molding a mixed powder of a metal powder and a ceramic powder by an injection molding method and sintering the resulting molded article.

According to this configuration, a polishing media having little dimensional variation and exhibiting a stable polishing property is obtained.

Another aspect of the invention is directed to a method for producing a polishing media including molding a mixed powder of a metal powder and a ceramic powder by an injection molding method to obtain a molded article and sintering the molded article to obtain a sintered body.

According to this configuration, a polishing media having little dimensional variation and exhibiting a stable polishing property can be efficiently produced.

Still another aspect of the invention is directed to a polishing method including stirring a polishing media formed of a sintered body in which a ceramic structure and a metal structure are intermingled with each other and a material to be polished in a barrel polishing tank.

According to this configuration, polishing can be efficiently and uniformly performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a polishing media, a method for producing a polishing media, and a polishing method according to embodiments of the invention will be described in detail with reference to the accompanying drawings.

Polishing Media

First, a polishing media according to an embodiment of the invention will be described.

Figure 1:
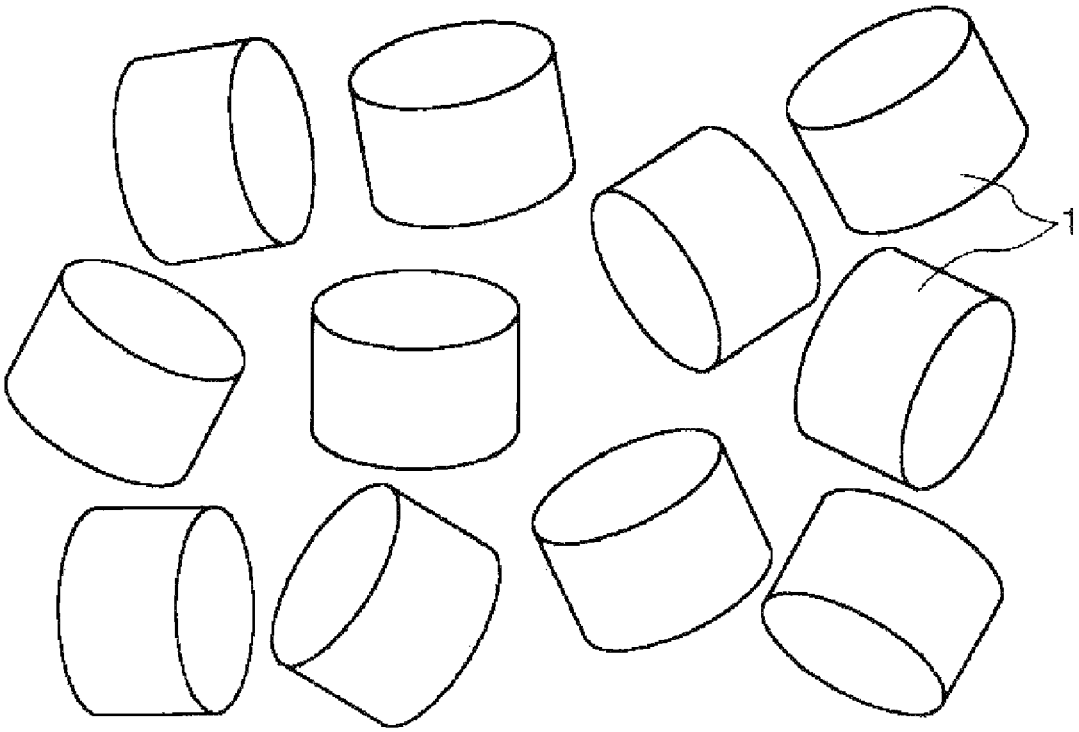
FIG. 1 is a view schematically showing a polishing media according to an embodiment of the invention.

FIG. 1 is a view schematically showing a polishing media according to an embodiment of the invention.

The polishing media is used for a polishing treatment such as barrel polishing, and is put in a barrel polishing tank together with a work which is a material to be polished. The polishing media repeatedly collides and rubs against the work, thereby polishing the surface of the work.

The polishing media 1 shown in FIG. 1 is a particulate body with a substantially columnar shape, and the particulate body is formed of a sintered body in which a metal structure and a ceramic structure are intermingled with each other. Because of being formed of such a sintered body, the polishing media 1 has a high specific gravity, and excellent impact resistance and toughness, each of which is attributed to the metal, and has a high hardness and high friction resistance, each of which is attributed to the ceramic. As a result, the polishing media 1 has a high polishing force even if it is small, and can achieve a polishing treatment efficiently in a short time even for a small work or a work in the shape of having a concave portion in the surface thereof.

In addition, since the entire polishing media 1 formed of a sintered body is substantially homogeneous, a problem such as cracking, exfoliation, or chipping is hardly caused. Further, since the entire polishing media 1 is homogeneous, even if the abrasion thereof proceeds, a change in polishing property is hardly caused. Accordingly, the polishing media 1 exhibits a stable polishing force for a long period of time.

Figure 2:
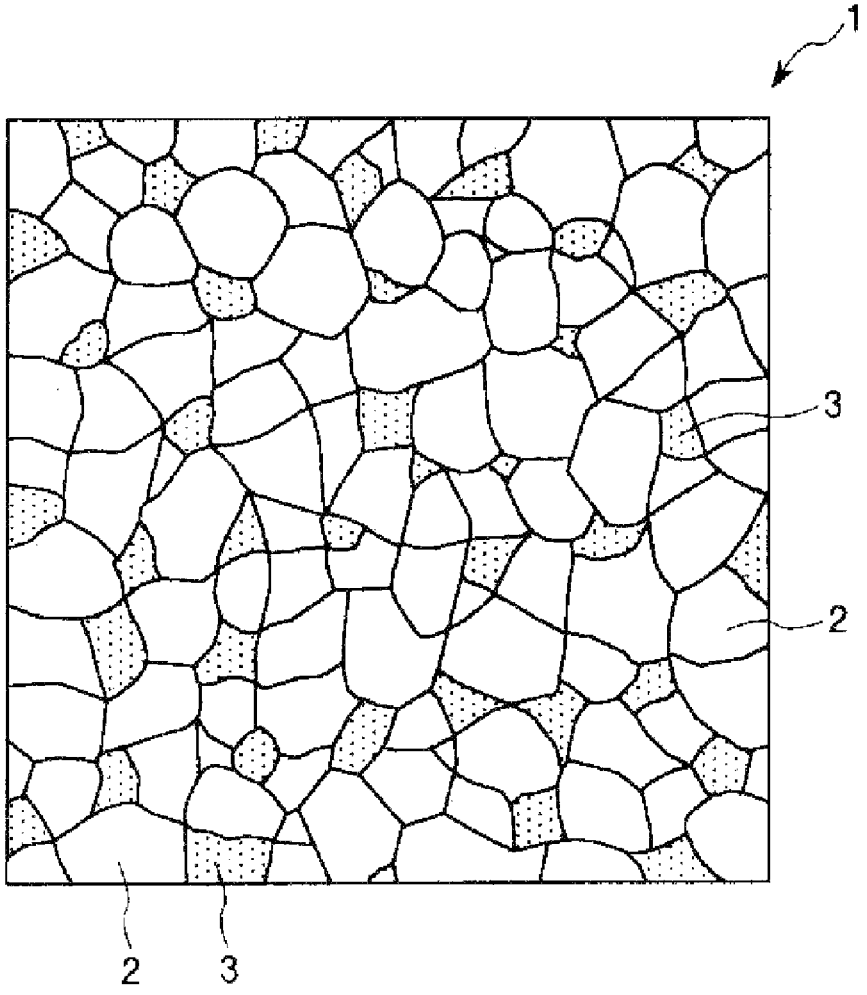
FIG. 2 is a cross-sectional view of the polishing media shown in FIG. 1.

FIG. 2 is a cross-sectional view of the polishing media 1 shown in FIG. 1. During barrel polishing, a lot of pieces of the polishing media are put in a barrel polishing tank, however, hereinafter, one piece of the polishing media will be described.

As shown in FIG. 2, the polishing media 1 is configured such that a plurality of metal structures 2 and a plurality of ceramic structures 3 are intermingled with one another, and the adjacent structures are chemically bonded to each other. This bond is formed by sintering, and is accompanied by atomic diffusion based on liquid phase sintering, solid phase sintering, or the like. In other words, the polishing media 1 is composed of a sintered body in which metal grains and ceramic grains are intermingled with each other.

A metal material which forms the metal structure 2 is not particularly limited, however, examples thereof include Al, Sc, Ti, V, Cr, Mn, Fe, Co, Ni, Cu, Zn, Ca, Ge, Y, Zr, Nb, Mo, Tc, Ru, Rh, Pd, Ag, Cd, In, Sn, Sb, Hf, Ta, W, Re, Os, Ir, Pt, Au, Tl, Pb, Bi, and Po, and one type of metal among these or an alloy, a mixture, an intermetallic compound, or the like containing two or more types of metals among these is used.

Among these, a material containing chromium, iron, cobalt, nickel, zirconium, niobium, tantalum, tungsten, or the like is preferably used, and a material containing tungsten is particularly preferably used. Such a metal material has a relatively high specific gravity and also has an excellent sintering property, and therefore can increase the specific gravity of the polishing media 1 and can enhance the impact resistance thereof. Accordingly, such a material is preferred as a material which forms the metal structure 2. Examples of the metal material containing tungsten include, other than a simple substance of tungsten, a tungsten-chromium alloy, a tungsten-iron alloy, a tungsten-cobalt alloy, a tungsten-nickel alloy, a tungsten-rhenium alloy, a tungsten-niobium alloy, a tungsten-molybdenum alloy, and a tungsten-tantalum alloy. Further, the metal structure 2 may contain an element which is an unavoidable contaminant incorporated during the formation of the metal structure.

Further, the metal material to be used has a specific gravity of preferably 8.5 or more, more preferably 9 or more. According to this configuration, the polishing media 1 has a mass capable of exhibiting a sufficient polishing force even if the media 1 is small.

Further, the metal structure 2 may be formed of a magnetic material. By using a magnetic material to form the metal structure 2, the polishing media 1 becomes a magnetic media which can be used for magnetic barrel polishing.

Examples of the magnetic material include Fe-based magnetic materials such as pure iron, ferrite stainless steel, sendust, permalloy, permendur, and Fe—Si; and also include Ni-based magnetic materials, and Co-based magnetic materials. Among these, preferably, an Fe-based magnetic material is used, and more preferably, pure iron or ferrite stainless steel is used. Such a material has a high magnetic property and therefore is useful in the magnetic media.

The magnetic material may be a hard magnetic material, however, is preferably a soft magnetic material. Since a soft magnetic material has a low coercive force, when the polishing media 1 is taken out of a barrel polishing tank after completion of magnetic barrel polishing, the pieces of the polishing media 1 hardly aggregate with each other. As a result, the handling property of the polishing media 1 is improved.

The size of the metal structure 2 is not particularly limited, however, the average particle diameter thereof is preferably 0.5 μm or more and 30 μm or less, more preferably 1 μm or more and 20 μm or less, further more preferably 2 μm or more and 10 μm or less. By setting the average particle diameter of the metal structure 2 within the above range, the polishing media 1 has an excellent binding property between the metal structures 2 and between the metal structure 2 and the ceramic structure 3, and also has an excellent mechanical property such as impact resistance.

The average particle diameter of the metal structure 2 is measured as follows.

First, the polishing media 1 is cut and the cross section (transverse section) thereof is observed using an optical microscope, an electron microscope, or the like. Subsequently, an area occupied by one metal structure 2 in the transverse section of the polishing media 1 is measured by image processing or the like. Then, a diameter of a circle having the same area as the area obtained by the measurement (an equivalent circle diameter) is taken as the particle diameter of the metal structure 2. The measurement is performed for 100 metal structures 2 in the same manner, and an average of the particle diameters obtained by the measurement is calculated as the average particle diameter. If the boundary between the metal structure 2 and the ceramic structure 3 in the transverse section of the polishing media 1 is not clear, an elemental mapping analysis is performed for the transverse section, and a region occupied by the metal structure 2 may be specified on the basis of the elemental distribution.

The shape of the metal structure 2 is not particularly limited, however, the metal structure 2 preferably has a particulate shape such as a substantially spherical shape. According to this configuration, a filling property of the metal structure 2 and the ceramic structure 3 is improved, and the mechanical property of the polishing media 1 can be further enhanced.

The metal structure 2 may be a crystalline structure or an amorphous structure, or moreover, may be a structure in which these structures are mixed in together.

On the other hand, a ceramic material which forms the ceramic structure 3 is not particularly limited, however, examples thereof include oxide-based ceramics such as aluminum oxide, zirconium oxide, magnesium oxide, calcium oxide, silicon oxide, titanium oxide, and iron oxide; nitride-based ceramics such as aluminum nitride, silicon nitride, and titanium nitride; hydrocarbon-based ceramics such as silicon carbide, titanium carbide, and tungsten carbide; and boride-based ceramics such as zirconium boride and titanium boride. Two or more types of materials among these may be mixed in together. Further, like cordierite, mullite, or steatite, a material in which several types of ceramics are mixed in together is also used.

Among these, aluminum oxide, zirconium oxide, aluminum nitride, silicon carbide, and tungsten carbide are preferably used, and aluminum oxide is particularly preferably used. Such a ceramic material has a high hardness and also has relatively high impact resistance, and therefore can enhance the polishing force of the polishing media 1. Accordingly, such a material is preferred as a material which forms the ceramic structure 3.

The size of the ceramic structure 3 is not particularly limited, however, the average particle diameter thereof is preferably 0.1 μm or more and 20 μm or less, more preferably 0.2 μm or more and 10 μm or less, further more preferably about 0.3 μm or more and 5 μm or less. By setting the average particle diameter of the ceramic structure 3 within the above range, the polishing media 1 has an excellent binding property between the ceramic structures 3 and between the ceramic structure 3 and the metal structure 2, and also has an excellent mechanical property such as impact resistance.

The average particle diameter of the ceramic structure 3 is measured in the same manner as that of the metal structure 2.

The average particle diameter of the ceramic structure 3 may be larger than that of the metal structure 2, but is preferably set to be smaller than that of the metal structure 2. In the polishing media 1, a percentage of the contribution of the ceramic structure 3 to the polishing of the surface of the work is large, and therefore, a larger load is applied to the ceramic structure 3. Accordingly, if the average particle diameter of the ceramic structure 3 is smaller than that of the metal structure 2, even if this load is applied, the ceramic structure 3 is hardly detached from the polishing media 1. In other words, the ceramic structure 3 is easily fixed by the metal structure 2.

Specifically, when the average particle diameter of the metal structure 2 is taken as 1, the average particle diameter of the ceramic structure 3 is preferably set to 0.05 or more and 0.5 or less, more preferably 0.1 or more and 0.3 or less. When the polishing media 1 is formed of, for example, a sintered body using a metal powder and a ceramic powder, this ratio is substantially equal to a ratio obtained from the average particle diameter of the metal powder and the average particle diameter of the ceramic powder.

Further, the shape of the ceramic structure 3 is not particularly limited, however, in the same manner as the case of the metal structure 2, the ceramic structure 3 preferably has a particulate shape such as a substantially spherical shape.

Further, the ceramic structure 3 may be formed of a magnetic material. By using a magnetic material to form the ceramic structure 3, the polishing media 1 becomes a magnetic media which can be used for magnetic barrel polishing.

Examples of the magnetic material include ferrite ceramic.

The abundance ratio between the metal structure 2 and the ceramic structure 3 in the polishing media 1 is not particularly limited, however, it is preferred that the ratio of the metal structure 2 is larger. This is because a metal has higher impact resistance after sintering as compared with a ceramic, and therefore, by setting the ratio of the metal structure 2 to be larger so as to make the property derived from the metal structure 2 dominant in the entire polishing media 1, cracking, chipping, or the like is hardly caused in the polishing media 1.

The abundance ratio between the metal structure 2 and the ceramic structure 3 is measured as follows.

First, the polishing media 1 is cut and the cross section (transverse section) thereof is observed using an optical microscope, an electron microscope, or the like. Subsequently, in a region containing 100 or more metal structures 2 and 100 or more ceramic structures 3 in the transverse section of the polishing media 1, an area occupied by the metal structures 2 and an area occupied by the ceramic structures 3 are measured, and a ratio therebetween is taken as the abundance ratio. If the boundary between the metal structure 2 and the ceramic structure 3 in the transverse section of the polishing media 1 is not clear, an elemental mapping analysis is performed for the transverse section, and a region occupied by the metal structure 2 and a region occupied by the ceramic structure 3 may be specified on the basis of the elemental distribution.

Further, in this case, when an area occupied by the metal structure 2 is taken as 1, an area occupied by the ceramic structure 3 is preferably 0.1 or more and less than 1, more preferably 0.15 or more and 0.7 or less, further more preferably 0.2 or more and 0.5 or less. According to this configuration, the above-described advantages become more significant, and both polishing force and durability can be highly achieved. This ratio is substantially equal to the volume ratio between the metal material and the ceramic material to be used when producing the polishing media 1.

Further, a combination of the metal material which forms the metal structure 2 and the ceramic material which forms the ceramic structure 3 is not particularly limited as long as it is a combination which enables the materials to stably exist in a state of a sintered body. However, a preferred combination is such that, between a main metal element in the metal material and a main metal element (including silicon or the like) in the ceramic material, a standard free energy of formation of the metal element in the metal material is larger than that of the metal element in the ceramic material. By selecting the materials in this manner, both of the metal material and the ceramic material can stably exist in a sintered body, and therefore, the durability of the polishing media 1 can be prevented from decreasing.

The standard free energies of formation to be compared are determined depending on the type of the ceramic material. For example, in the case of an oxide-based ceramic, the standard free energies of formation for an oxidation reaction may be compared.

Hereinabove, the metal structure 2 and the ceramic structure 3 are described, however, another structure may be contained in the polishing media 1 as needed. As the another structure, for example, a carbon structure or the like may be contained, and a void may be contained. However, when an area of the transverse section of the polishing media 1 is taken as 1, the ratio occupied by the metal structure 2 and the ceramic structure 3 in the polishing media 1 is preferably 0.9 or more, more preferably 0.93 or more. The polishing media 1 having such a configuration is sufficiently dense, and has an excellent mechanical property.

The polishing media according to the embodiment of the invention may have any shape. Examples of the shape of the polishing media include columnar shapes such as a cylinder and a prism; conical shapes such as a cone and a pyramid; and spherical shapes such as a sphere and an oval sphere. The polishing media may have an irregular shape (i.e., a non-uniform shape). Further, the polishing media may be a mixture of those having different shapes. Further, the polishing media may have a shape such that a portion of the surface thereof is recessed or protruded.

Among these, the shape of the polishing media 1 is preferably a columnar shape or a conical shape. In the case of having such a shape, the polishing media 1 has a side with a curved surface, a bottom with a flat surface, and a corner portion formed by the boundary thereof, and therefore, when the polishing media 1 tumbles, a scraping action and a polishing action against a work are brought about. As a result, a useful polishing media 1 with which deburring and surface finishing can be performed simultaneously, and so on is realized.

The polishing media 1 shown in FIG. 1 has a substantially cylindrical shape.

The size of the polishing media 1 is appropriately selected depending on the size, shape, or the like of a work, however, for example, the maximum length is preferably 0.1 mm or more and 10 mm or less, more preferably 0.3 mm or more and 5 mm or less. Even if the size thereof is small in this manner, the polishing media according to the embodiment of the invention has a sufficient polishing force, and therefore is useful for polishing a small work or a work having a concave portion in the surface thereof.

Further, the polishing media 1 may have an anisotropic shape, but preferably has an isotropic shape. According to this configuration, uniform polishing can be achieved. For example, in the case of the polishing media 1 having a substantially cylindrical shape as shown in FIG. 1, the shape of each of the upper and lower surfaces is close to a true circle, and it suffices that the diameter of the circle and the height of the cylinder may be substantially equal to each other.

When the polishing media 1 is used for barrel polishing, the surface of a work is polished and at the same time, also the surface of the polishing media 1 is worn away. Among the polishing media in the related art, there are some in which due to this wearing away, a surface having a property different from that before being worn away appears, and therefore, also the polishing property differs. When the polishing media is put into such a state, a polished state of the work is not uniform.

On the other hand, the polishing media 1 according to the embodiment of the invention is configured such that the entire polishing media is homogeneously formed of a sintered body in which a metal structure and a ceramic structure are intermingled with each other, and therefore, even if the surface thereof is worn away, a surface having the same property as before being worn away appears continuously. Accordingly, polishing can be continuously performed by the polishing media with a surface having the same property, and as a result, a polished state of the work can be made uniform.

Method for Producing Polishing Media

Subsequently, a method for producing a polishing media 1 (the method for producing a polishing media according to an embodiment of the invention) will be described.

The polishing media 1 is produced by a powder metallurgical process in which a mixed powder of a metal powder and a ceramic powder is molded and the resulting molded article is sintered.

This production method includes [1] a kneading step of kneading a mixed powder, [2] a molding step of producing a molded article, [3] a degreasing step of performing a degreasing treatment, and [4] a sintering step of performing sintering. Hereinafter the respective steps will be described sequentially.

[1] Kneading Step

First, a metal powder, a ceramic powder, and a binder are prepared, and these ingredients are kneaded using a kneader, whereby a kneaded material (composition) is obtained. In the obtained kneaded material, the metal powder and the ceramic powder are uniformly intermingled with each other, and further the binder is uniformly dispersed.

As the metal powder and the ceramic powder to be used, those having average particle diameters substantially equal to those of the above-described metal structure 2 and the ceramic structure 3, respectively, are used.

Examples of the binder include a variety of organic binders such as polyolefins (such as polyethylene, polypropylene, and ethylene-vinyl acetate copolymers), acrylic resins (such as polymethyl methacrylate and polybutyl methacrylate), styrene resins (such as polystyrene), polyvinyl chloride, polyvinylidene chloride, polyamides, polyesters (such as polyethylene terephthalate and polybutylene terephthalate), polyethers, polyvinyl alcohols, or a variety of resins such as copolymers thereof, a variety of waxes, paraffins, higher fatty acids (such as stearic acid), higher alcohols, higher fatty acid esters, and higher fatty acid amides, and these binders can be used alone or in admixture of two or more.

Among these, a binder containing a polyolefin as a main component is preferred as the binder. A polyolefin has relatively high degradability by a reducing gas. Therefore, if a polyolefin is used as a main component of the binder, it is possible to reliably degrease the molded article in a shorter time.

Further, the content of the binder is preferably about 10% by volume or more and 70% by volume or less, more preferably about 20% by volume or more and 60% by volume or less of the total volume of the kneaded material. If the content of the binder falls within the above range, the molded article can be formed with good moldability, and also the density of the molded article is increased and the stability of the shape of the molded article and the like can be particularly enhanced. As a result, a difference in size between the molded article and the degreased article, in other words, a shrinkage ratio is optimized, whereby the dimensional accuracy of the finally obtained sintered body can be prevented from decreasing.

Further, to the kneaded material, a plasticizer may be added as needed. Examples of the plasticizer include phthalate esters (such as DOP, DEP, and DBP), adipate esters, trimellitate esters, and sebacate esters, and these plasticizers can be used alone or in admixture of two or more.

Further, to the kneaded material, other than the above-described ingredients, for example, any of a variety of additives such as an antioxidant, a degreasing accelerator, a surfactant, a dispersing agent, and a lubricant can be added as needed.

The kneading conditions vary depending on various conditions such as the composition of the metal powder to be used and the particle diameter of the metal powder, the composition of the binder, and the mixing amounts of these ingredients, however, for example, the kneading temperature can be set to about 50° C. or higher and 200° C. or lower, and the kneading time can be set to about 15 minutes or more and 210 minutes or less.

Further, the kneaded material is pelletized (formed into small pieces) as needed. The particle diameter of each pellet is set to, for example about 1 mm or more and 15 mm or less.

In place of the kneaded material, a granulated powder may be produced.

[2] Molding Step

Subsequently, the kneaded material is molded, whereby a molded article having the same shape as a desired sintered body is produced.

A method for producing a molded article (a molding method) is not particularly limited, and for example, any of a variety of molding methods such as a powder compacting molding (compacting molding) method, a metal powder injection molding (metal injection molding (MIM)) method, and an extrusion molding method can be used. However, in the production of the polishing media 1, particularly, a metal powder injection molding method is preferably used. According to this molding method, even if the polishing media 1 having a complicated shape is produced, a molded article having a shape close to the final shape can be obtained. Due to this, merely by degreasing and sintering the resulting molded article, a polishing media 1 having various shapes can be produced simply and stably without performing post-processing, and therefore, the method is advantageous from the viewpoint of production efficiency and prevention of dimensional variation. In particular, in the case of the polishing media 1, the shape thereof largely affects the polishing property, and therefore, in order to obtain a constant polishing property, it is necessary that the shape of each piece of the polishing media 1 be uniform.

The molding conditions in the case of using a metal powder injection molding method vary depending on various conditions, however, it is preferred to set the material temperature to about 80° C. or higher and 210° C. or lower, and the injection pressure to about 5 MPa or more and 500 MPa or less (0.05 t/cm$^2$ or more and 5 t/cm$^2$ or less). In the molded article obtained in this manner, the binder is uniformly dispersed in voids among particles of the metal powder and the ceramic powder.

The molding conditions in the case of using a powder compacting molding method vary depending on various conditions such as the composition of the metal powder to be used and the particle diameter of the metal powder, the composition of the binder, and the mixing amounts of these ingredients, however, it is preferred to set the molding pressure to about 200 MPa or more and 1000 MPa or less (2 t/cm$^2$ or more and 10 t/cm$^2$ or less).

Further, although the molding conditions in the case of using an extrusion molding method vary depending on various conditions, it is preferred to set the material temperature to about 80° C. or higher and 210° C. or lower, and the extrusion pressure to about 50 MPa or more and 500 MPa or less (0.5 t/cm$^2$ or more and 5 t/cm$^2$ or less).

In any case, the shape and the dimensions of the molded article to be produced are determined by taking into consideration the shrinkage of the molded article in the subsequent degreasing step and sintering step.

[3] Degreasing Step

Subsequently, by subjecting the obtained molded article to a degreasing treatment (a binder removal treatment), whereby a degreased article is obtained.

Specifically, the binder is removed from the molded article by heating the molded article to degrade the binder. In this manner, the degreasing treatment can be performed.

In this degreasing treatment, for example, a method of heating the molded article, a method of exposing the molded article to a gas which degrades the binder, or the like is used.

In the case of using a method of heating the molded article, the conditions for heating the molded article slightly vary depending on the composition of the binder and the blending amount thereof, however, it is preferred to set the temperature to 100° C. or higher and 750° C. or lower, and the degreasing time to about 0.1 hour or more and 20 hours or less, and it is more preferred to set the temperature to 150° C. or higher and 600° C. or lower, and the degreasing time to about 0.5 hour or more and 15 hours or less. By setting the conditions in this manner, the molded article can be degreased in a necessary and sufficient manner without sintering the molded article. As a result, a large amount of the binder component can be reliably prevented from remaining in the degreased article.

Further, an atmosphere when the molded article is heated is not particularly limited, and a reducing gas atmosphere such as hydrogen, an inert gas atmosphere such as nitrogen or argon, an oxidative gas atmosphere such as air, or a reduced pressure atmosphere obtained by reducing the pressure of any of such atmospheres or the like is used.

As the gas which degrades the binder, for example, ozone gas or the like is used.

By dividing the degreasing step into a plurality of steps adopting different degreasing conditions, and performing the divided steps, the binder in the molding article can be more promptly degraded and removed without leaving the binder in the molded article.

Further, if necessary, the degreased article may be subjected to mechanical processing such as shaving, polishing, or cutting. The degreased article has a relatively low hardness and also has relatively high plasticity, and therefore, the degreased article can be easily subjected to mechanical processing while preventing the shape thereof from collapsing. By such mechanical processing, a sintered body having high dimensional accuracy can be easily obtained in the end.

[4] Sintering Step

The degreased article obtained in the step [3] is sintered in a sintering furnace, whereby a sintered body is obtained.

By this sintering, the metal powder is diffused across the boundaries of the particles, and therefore, sintering is achieved. Further, it is considered that the diffusion of some of the metal powder is caused also across the boundaries with the ceramic powder. In this manner, the sintered body in which the metal structure 2 and the ceramic structure 3 are uniformly intermingled with each other is obtained.

Further, when the mixing amount of the metal powder is larger than that of the ceramic powder, the metal particles are sintered so as to surround the ceramic particles at a high probability. As a result, even if the binding force between the metal powder and the ceramic powder is low, the mechanical property of the polishing media 1 is prevented from decreasing and a media which is hardly broken can be obtained. In general, the shape of the ceramic particle easily becomes irregular, and therefore, when the metal particles are disposed so as to surround the ceramic particles, slippage of the particles is hardly caused between the ceramic particles and the metal particles. Consequently, the ceramic particles can be easily fixed and the mechanical property of the polishing media 1 is improved.

The sintering conditions in this step slightly vary depending on the compositions of the metal powder and the ceramic powder used in the production of the molded article and the degreased article, the particle diameters thereof, and the like, however, it is preferred to set the temperature to 1100° C. or higher and 1600° C. or lower, and the sintering time to about 0.2 hour or more and 7 hours or less, and it is more preferred to set the temperature to 1200° C. or higher and 1500° C. or lower, and the sintering time to about 1 hour or more and 4 hours or less. By setting the conditions in this manner, the entire degreased article can be sufficiently sintered while preventing the sintering from excessively proceeding to enlarge the crystal structure due to the excessive sintering. As a result, a sintered body having a high density and also having a particularly superior mechanical property can be obtained.

Further, an atmosphere when sintering the degreased article is not particularly limited, however, when taking into consideration the prevention of oxidation of the metal powder, a reducing gas atmosphere such as hydrogen, an inert gas atmosphere such as nitrogen or argon, or a reduced pressure atmosphere obtained by reducing the pressure of any of such atmospheres or the like is preferably used.

As described above, the polishing media 1 formed of the sintered body is obtained.

The method for producing a polishing media 1 is not limited to the above method, and for example, a casting method in which a molten metal having a ceramic powder dispersed therein is casted into a given shape, a die-casting method in which the material is injected directly into a mold, or the like can also be used.

Polishing Method

Subsequently, the polishing method according to the embodiment of the invention will be described.

Figure 3:
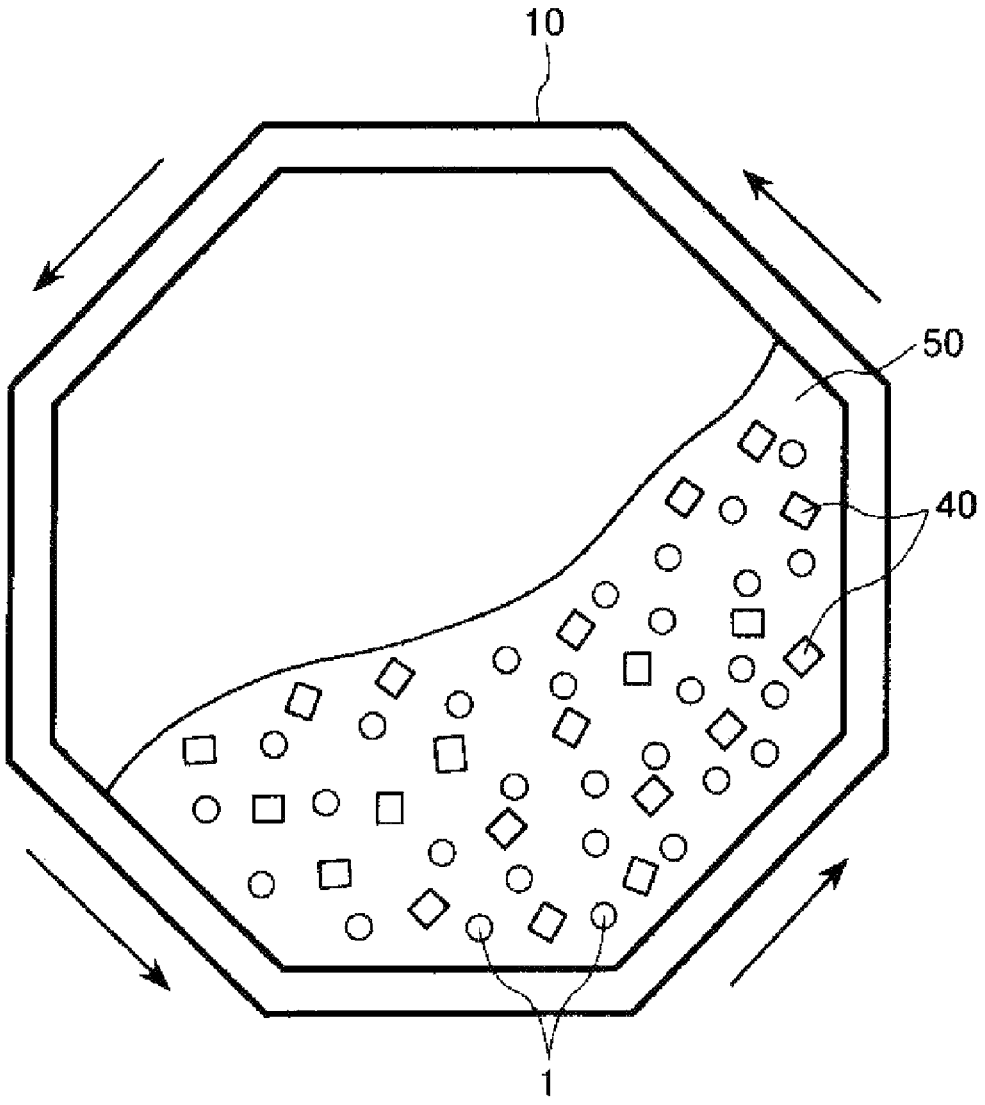
FIG. 3 is a view (cross-sectional view) schematically showing a barrel polishing tank to be used in a polishing method according to an embodiment of the invention.

FIG. 3 is a view (cross-sectional view) schematically showing a barrel polishing tank to be used in a polishing method according to an embodiment of the invention.

The barrel polishing tank is a vessel having a cylindrical shape, a polygonal shape, or the like. A work 40 and the polishing media 1 are put therein, and then, the vessel is vibrated, rotated, or the like. By doing this, the work 40 and the polishing media 1 move, and the surface of the work 40 is polished by utilizing a difference in relative movement therebetween.

In the barrel polishing, there are several processes divided by the mode of movement of the contents, and for example, rotary barrel polishing, vibrating barrel polishing, centrifugal barrel polishing, vortex barrel polishing, magnetic barrel polishing, and the like are known, and the polishing media 1 can be used for any of these.

A barrel polishing tank 10 shown in FIG. 3 is a polishing tank for use in rotary barrel polishing having an octagonal columnar shape. The axis line of a columnar body is disposed along the horizontal direction, and becomes a rotation axis of the barrel polishing tank 10. When the barrel polishing tank 10 is rotated about the rotation axis as the center, accompanied by the rotation, the contents move vertically upward along the inner wall surface of the barrel polishing tank 10, and when reaching a given height, the contents move downward as if collapsing. At this time, the contents vigorously flow, and an impact force or a frictional force is generated between the work 40 and the polishing media 1. As a result, the surface of the work 40 is polished.

The ratio between the work 40 and the polishing media 1 to be put in the barrel polishing tank 10 is not particularly limited, however, in general, the ratio is set such that the volume of the polishing media 1 is larger than that of the work 40. For example, when the volume of the work 40 is taken as 1, the volume of the polishing media 1 may be set to about 1.5 or more and 10 or less.

The barrel polishing may be a dry process or a wet process.

Further, in the barrel polishing tank 10, another additive 50 is put as needed. Examples of the another additive include liquids such as water and organic solvents and cleaning agents (compounds).

Hereinabove, the invention is described on the basis of the embodiments shown in the drawings, however, the invention is not limited thereto. For example, to the polishing method according to the embodiment of the invention, a step for a given purpose may be added.

EXAMPLES

1. Production of Polishing Media

Example 1

[1] First, a tungsten powder having an average particle diameter of 3 μm and an alumina powder having an average particle diameter of 0.5 μm were mixed at a volume ratio of 4:1, whereby a mixed powder was obtained. Subsequently, the obtained mixed powder and a binder were weighed to give a volume ratio of 55:45 and were mixed with each other, whereby a mixed starting material was obtained. As the binder, polypropylene and a wax were used. Further, as an additive, stearic acid was added. The mixing amounts of the polypropylene, wax, and stearic acid were 5 parts by mass, 5 parts by mass, and 2 parts by mass, respectively, based on 100 parts by mass of the mixed powder.

Then, the obtained mixed starting material was kneaded using a kneader, whereby a compound was obtained.

[2] Subsequently, the obtained compound was molded using an injection molding device under the following molding conditions, whereby a molded article was obtained.

Molding Conditions

Material temperature: 150° C.

Injection pressure: 11 MPa (110 kgf/cm$^2$)

Molding shape: a cylinder having a bottom diameter of 0.5 mm and a height of 0.5 mm

[3] Subsequently, the obtained molded article was subjected to a heating treatment (degreasing treatment) under the following degreasing conditions, whereby a degreased article was obtained.

Degreasing Conditions

Heating temperature: 500° C.

Heating time: 2 hours

Heating atmosphere: nitrogen gas

[4] Subsequently, the obtained degreased article was sintered under the following sintering conditions. By doing this, a sintered body (polishing media) was obtained.

Sintering Conditions

Sintering temperature: 1400° C.

Sintering time: 3 hours

Heating atmosphere: reduced pressure (300 Pa)

The obtained sintered body was configured such that a metal structure and a ceramic structure were intermingled with each other.

Then, a cross section of the sintered body was observed using a scanning electron microscope, and the average particle diameter of the ceramic structure was determined when the average particle diameter of the metal structure was taken as 1. The result is shown in Table 1 expressed as a particle diameter ratio.

Further, in the entire cross section, an area occupied by the ceramic structure was determined when an area occupied by the metal structure is taken as 1. The result is shown in Table 1 expressed as an area ratio Examples 2 to 17

Sintered bodies (polishing media) were obtained in the same manner as in Example 1, respectively, except that the conditions for producing the polishing media were changed as shown in Table 1.

Examples 18 to 20

Sintered bodies (polishing media) were obtained in the same manner as in Example 1, respectively, except that as the metal powder, two types of tungsten powders having different average particle diameters were used, and also the other production conditions were changed as shown in Table 1. The mixing ratio of the two types of powders was set to 1:1 on the volume basis.

Examples 21 to 23

Sintered bodies (polishing media) were obtained in the same manner as in Example 1, respectively, except that as the ceramic powder, a zirconium powder was used, and also the other production conditions were changed as shown in Table 1.

Examples 24 and 25

Sintered bodies (polishing media) were obtained in the same manner as in Example 1, respectively, except that the shape of the polishing media was changed to a conical shape, and also the other production conditions were changed as shown in Table 1. The dimensions of the cone were set such that the bottom diameter was 0.5 mm and the height was 0.5 mm.

Examples 26 and 27

Sintered bodies (polishing media) were obtained in the same manner as in Example 1, respectively, except that the molding method was changed to a powder compacting molding method, and also the other production conditions were changed as shown in Table 1. The conditions for the powder compacting molding were as follows.

Molding Conditions

Granulation method: tumbling granulation method (average particle diameter: 30 μm)

Molding method: press molding

Molding pressure: 500 MPa

Material temperature: 90° C.

Examples 28 and 29

Sintered bodies (polishing media) were obtained in the same manner as in Example 1, respectively, except that as the metal powder, a molybdenum powder was used, and also the other production conditions were changed as shown in Table 1.

Examples 30 to 32

Sintered bodies (polishing media) were obtained in the same manner as in Example 1, respectively, except that as the metal powder, a ferrite stainless steel powder (SUS430) was used, and also the other production conditions were changed as shown in Table 1.

Comparative Example 1

As a polishing media, a cylindrical alumina bead media (specific gravity: 3.5, Mohs hardness: 9, manufactured by Shinto Brator Co., Ltd.) having a bottom diameter of 0.5 mm and a height of 0.5 mm was used.

Comparative Example 2

As a polishing media, a cylindrical stainless steel (SUS430) pin (specific gravity: 0.79, manufactured by Shinto Brator Co., Ltd.) having a bottom diameter of 0.5 mm and a height of 0.5 mm was used.

Comparative Example 3

A sintered body (polishing media) was obtained in the same manner as in Example 1 except that the addition of the ceramic powder was omitted.

Comparative Example 4

First, a Co-based metal bond in the form of a powder having an average particle diameter of 1.4 μm was prepared, and diamond abrasive particles having a particle diameter of 10 to 20 μm were added thereto in an amount of 20% by mass and mixed therein, whereby a mixed powder was obtained. Then, polyvinyl alcohol was added thereto, whereby a composition for an abrasive material layer was prepared.

Subsequently, the obtained composition for an abrasive material layer and the sintered body obtained in Comparative Example 3 were put in a tumbling granulator, and granulation was performed, whereby a coating film for an abrasive material layer having an average thickness of 0.2 mm was obtained on the surface of the sintered body.

Then, the resulting sintered body with the coating film was placed on a sintering plate, and sintered at 900° C. in a hydrogen atmosphere for 3 hours, whereby a polishing media in which the sintered body obtained in Comparative Example 3 is coated with the abrasive material layer having an average thickness of 0.15 mm was obtained.

2. Evaluation for Polishing Treatment 2.1. Evaluation of Specific Gravity (Density)

For the polishing media obtained in the respective Examples and the respective Comparative Examples, the specific gravity (density) was evaluated as follows. Arbitrary 100 pieces were extracted from the polishing media obtained in each of the Examples and the Comparative Examples, and among the 100 pieces, 10 pieces were chosen as one set and the specific gravity (density) thereof was measured by the Archimedian method. For the remaining 90 pieces, the measurement was performed in the same manner, and an average of the measured values for 10 sets was obtained. The obtained average was taken as the specific gravity of the polishing media of each of the Examples and the Comparative Examples.

2.2. Evaluation of Polishing Accuracy

First, a light transmissive alumina work (surface roughness Ra: 2 μm) in the shape of a cube with a side length of 5 mm was prepared. This work has a cylindrical hole having a diameter of 3 mm and a depth of 3 mm in the center of one surface.

Subsequently, 1000 $cm^3$ of the work and 4000 $cm^3$ of the polishing media were put in a barrel polishing tank of a rotary barrel polishing device. In addition, water and a compound (Toriston L-5, manufactured by Kimura Soap Industry, Co., Ltd.) were also put therein. The concentration of the compound was set to 2% by mass in the mixed liquid containing the compound and water. Further, the amount of water to be added was set to 5000 $cm^3$, and the amount of the total contents put in the tank was set to 55% of the volume of the barrel polishing tank.

Then, barrel polishing was performed by rotating the tank at a rotation speed of 20 rpm for 60 hours.

Thereafter, arbitrary 100 pieces of the work were extracted from the barrel polishing tank, and the surface roughness Ra specified in JIS B 0601 was measured for each piece using a stylus type roughness tester. A region to be measured was determined to be on a surface which does not have the hole among the 6 surfaces of the cubic work. Then, an average of the measured values for the 100 pieces was obtained, and the obtained average was taken as the surface roughness Ra for each of the Examples and the Comparative Examples.

2.3. Evaluation of Polishing Uniformity

Subsequently, a standard deviation was calculated for the surface roughness Ra measured in 2.2. Then, the standard deviation for Comparative Example 1 was taken as 1, and a relative value of each standard deviation compared to the standard deviation for Comparative Example 1 was taken as an index for the uniformity of the surface roughness Ra. This index was evaluated according to the following evaluation criteria.

Evaluation Criteria for Polishing Uniformity

A: The index is less than 0.5.

B: The index is 0.5 or more and less than 0.7.

C: The index is 0.7 or more and less than 0.9.

D: The index is 0.9 or more and less than 1.

E: The index is 1 or more.

2.4. Evaluation for Outer Appearance of Media

Subsequently, 10 pieces of the polishing media used in the barrel polishing in 2.2 were observed using an optical microscope, and the outer appearance thereof was confirmed. Then, evaluation was performed according to the following evaluation criteria.

Evaluation Criteria for Outer Appearance of Media

A: The number of pieces of the media which are cracked or chipped is 0.

B: The number of pieces of the media which are cracked or chipped is 1.

C: The number of pieces of the media which are cracked or chipped is 2 or 3.

D: The number of pieces of the media which are cracked or chipped is 4 or 5.

E: The number of pieces of the media which are cracked or chipped is 6 or more.

The evaluation results obtained in 2.1 to 2.4 are shown in Table 1.

TABLE 1

| | Production conditions for polishing media | | | | | | | | Evaluation results | | | |
|---|---|---|---|---|---|---|---|---|---|---|---|---|
| | Metal powder | | Ceramic powder | | | | | | | | | |
| | Composition | Average particle diameter (μm) | Composition | Average particle diameter (μm) | Particle diameter ratio | Area ratio | Shape | Molding method | Specific gravity | Surface roughness Ra (μm) | Polishing uniformity | Outer appearance of media |
| Example 1 | W | 3 | $Al_2O_3$ | 0.5 | 0.17 | 0.25 | Cylinder | Injection | 15.5 | 0.08 | A | A |
| Example 2 | W | 5 | $Al_2O_3$ | 0.5 | 0.10 | 0.25 | Cylinder | Injection | 15.5 | 0.12 | A | A |
| Example 3 | W | 3 | $Al_2O_3$ | 0.9 | 0.30 | 0.25 | Cylinder | Injection | 15.5 | 0.15 | A | A |
| Example 4 | W | 8 | $Al_2O_3$ | 0.7 | 0.09 | 0.25 | Cylinder | Injection | 15.5 | 0.13 | B | B |
| Example 5 | W | 3 | $Al_2O_3$ | 0.2 | 0.07 | 0.38 | Cylinder | Injection | 13.4 | 0.21 | A | A |
| Example 6 | W | 12 | $Al_2O_3$ | 0.6 | 0.05 | 0.25 | Cylinder | Injection | 15.5 | 0.18 | B | C |
| Example 7 | W | 3 | $Al_2O_3$ | 1.4 | 0.47 | 0.25 | Cylinder | Injection | 15.5 | 0.16 | B | B |
| Example 8 | W | 15 | $Al_2O_3$ | 3.2 | 0.21 | 0.21 | Cylinder | Injection | 16.1 | 0.25 | B | B |
| Example 9 | W | 20 | $Al_2O_3$ | 5.6 | 0.28 | 0.28 | Cylinder | Injection | 15.0 | 0.31 | B | C |
| Example 10 | W | 27 | $Al_2O_3$ | 8.4 | 0.31 | 0.26 | Cylinder | Injection | 15.3 | 0.32 | B | C |
| Example 11 | W | 3 | $Al_2O_3$ | 0.5 | 0.17 | 0.12 | Cylinder | Injection | 17.5 | 0.11 | A | A |
| Example 12 | W | 3 | $Al_2O_3$ | 0.5 | 0.17 | 0.18 | Cylinder | Injection | 16.5 | 0.09 | A | A |
| Example 13 | W | 3 | $Al_2O_3$ | 0.5 | 0.17 | 0.36 | Cylinder | Injection | 13.8 | 0.14 | A | A |
| Example 14 | W | 3 | $Al_2O_3$ | 0.5 | 0.17 | 0.48 | Cylinder | Injection | 11.9 | 0.19 | A | A |
| Example 15 | W | 3 | $Al_2O_3$ | 0.5 | 0.17 | 0.67 | Cylinder | Injection | 9.0 | 0.27 | B | B |
| Example 16 | W | 3 | $Al_2O_3$ | 0.5 | 0.17 | 0.84 | Cylinder | Injection | 6.4 | 0.31 | C | B |
| Example 17 | W | 3 | $Al_2O_3$ | 0.5 | 0.17 | 0.96 | Cylinder | Injection | 4.5 | 0.33 | C | B |

TABLE 1-continued

| | Production conditions for polishing media | | | | | | | | Evaluation results | | | |
|---|---|---|---|---|---|---|---|---|---|---|---|---|
| | Metal powder | | Ceramic powder | | | | | | | | | |
| | Composition | Average particle diameter (μm) | Composition | Average particle diameter (μm) | Particle diameter ratio | Area ratio | Shape | Molding method | Specific gravity | Surface roughness Ra (μm) | Polishing uniformity | Outer appearance of media |
| Example 18 | W | 3.2 | $Al_2O_3$ | 0.5 | 0.20 | 0.25 | Cylinder | Injection | 15.5 | 0.05 | A | A |
| Example 19 | W | 5.2 | $Al_2O_3$ | 0.5 | 0.14 | 0.25 | Cylinder | Injection | 15.5 | 0.06 | A | A |
| Example 20 | W | 10.3 | $Al_2O_3$ | 0.5 | 0.08 | 0.25 | Cylinder | Injection | 15.5 | 0.08 | A | A |
| Example 21 | W | 3 | $ZrO_2$ | 0.6 | 0.20 | 0.28 | Cylinder | Injection | 15.6 | 0.07 | A | A |
| Example 22 | W | 3 | $ZrO_2$ | 0.9 | 0.30 | 0.31 | Cylinder | Injection | 15.2 | 0.09 | A | A |
| Example 23 | W | 3 | $ZrO_2$ | 1.5 | 0.50 | 0.25 | Cylinder | Injection | 16.0 | 0.13 | A | A |
| Example 24 | W | 3 | $Al_2O_3$ | 0.5 | 0.17 | 0.25 | Cone | Injection | 15.5 | 0.11 | A | B |
| Example 25 | W | 3 | $Al_2O_3$ | 1.2 | 0.40 | 0.32 | Cone | Injection | 14.4 | 0.18 | B | B |
| Example 26 | W | 3 | $Al_2O_3$ | 0.5 | 0.17 | 0.25 | Cylinder | Powder compacting | 15.5 | 0.25 | B | B |
| Example 27 | W | 3 | $Al_2O_3$ | 1.2 | 0.40 | 0.32 | Cylinder | Powder compacting | 14.4 | 0.29 | B | B |
| Example 28 | Mo | 5 | $Al_2O_3$ | 0.7 | 0.14 | 0.31 | Cylinder | Injection | 8.3 | 0.27 | B | B |
| Example 29 | Mo | 10 | $Al_2O_3$ | 1.5 | 0.15 | 0.33 | Cylinder | Injection | 8.2 | 0.29 | C | B |
| Example 30 | $SUS_{430}$ | 3 | $Al_2O_3$ | 0.5 | 0.17 | 0.25 | Cylinder | Injection | 6.8 | 0.59 | C | B |
| Example 31 | $SUS_{430}$ | 5 | $Al_2O_3$ | 0.8 | 0.16 | 0.34 | Cylinder | Injection | 6.4 | 0.71 | C | B |
| Example 32 | $SUS_{430}$ | 12 | $Al_2O_3$ | 1.5 | 0.13 | 0.42 | Cylinder | Injection | 6.1 | 0.82 | C | B |
| Comparative Example 1 | Alumina beads media | | | | | | | | 3.9 | 0.56 | — | E |
| Comparative Example 2 | Stainless steel pin media | | | | | | | | 7.7 | 1.51 | E | A |
| Comparative Example 3 | Tungsten media | | | | | | | | 19.3 | 0.34 | D | A |
| Comparative Example 4 | Media obtained by attaching diamond abrasive particles to surface of tungsten sintered body | | | | | | | | 18.5 | 0.28 | E | E |

As shown in Table 1, it was confirmed that in the case of using the polishing media obtained in each of the Examples, the surface roughness Ra of the work was very small, and the polishing result was favorable. Further, also in the concave portion, good polishing was achieved in the same manner. In the polishing evaluation for several polishing media, polishing was stopped every 10 hours during the 60-hour polishing, and the progress of the polishing degree was confirmed. As a result, it was confirmed that in the case of polishing with the media having a specific gravity exceeding 10, after 30-hour polishing, the polishing amount was suppressed, and the polishing was completed. It was also confirmed that in such a case, the surface roughness Ra was sufficiently small in the end.

Further, in the case of using the polishing media obtained in each of the Examples, the polishing uniformity was high and the outer appearance of the media was maintained relatively favorably. This is presumed to be because the polishing media obtained in each of the Examples has a high polishing force and also has high durability, and therefore, polishing can be completed in a short time, and due to this, the polishing uniformity can be relatively increased, and also even if it is used for a long period of time, it is difficult to cause abrasion, chipping, or the like.

On the other hand, when using the polishing media of each of the Comparative Examples, the surface roughness Ra could not be sufficiently decreased in some cases, and the polishing uniformity was not sufficient in some cases. Further, even if the surface roughness could be decreased to some extent, a problem was observed in the polishing uniformity or the outer appearance of the media.

The polishing media obtained in each of the Examples was cut and the cross section thereof was observed using a scanning electron microscope, and it was confirmed that a metal structure and a ceramic structure are intermingled with each other. Further, the average particle diameter of each structure was measured, and it was confirmed that the average particle diameter of each structure is substantially equal to that of the powder used.

The polishing media obtained in each of the Examples 30 to 32 was used also in a magnetic barrel polishing device, and it was confirmed that the polishing media exhibits a polishing force equal to that in the case of being used in a rotary barrel polishing device.

The entire disclosure of Japanese Patent Application No. 2011-074394, filed Mar. 30, 2011 is expressly incorporated by reference herein.

What is claimed is:

1. A polishing media comprising a sintered body in which a metal structure and a ceramic structure are intermingled with each other, wherein the metal structure consists of a metal selected from the group consisting of Sc, V, Ca, Ge, Y, Zr, Nb, Mo, Tc, Ru, Rh, Cd, In, Sb, Hf, Ta, Re, Os, Ir, Bi, and Po, and wherein in a cross section of the polishing media, an area occupied by the ceramic structure is 0.1 or more and less than 1 when an area occupied by the metal structure is taken as 1, and an average particle diameter of the ceramic structure is 0.05 or more and less than 0.5 when the average particle diameter of the metal structure is taken as 1.

2. The polishing media according to claim 1, wherein the polishing media has a columnar shape or a conical shape.

3. The polishing media according to claim 1, wherein the ceramic structure is formed of aluminum oxide.

4. The polishing media according to claim 1, wherein the metal structure is formed of tungsten.

5. The polishing media according to claim 1, wherein the ceramic structure is formed of a metal oxide, and a standard free energy of formation for an oxidation reaction of a metal element contained in the metal structure is larger than that of a metal element contained in the metal oxide.

6. The polishing media according to claim 1, wherein the sintered body is obtained by molding a mixed powder of a metal powder and a ceramic powder by an injection molding method and sintering the resulting molded article.

* * * * *